US010631690B2

(12) United States Patent
Stewart

(10) Patent No.: US 10,631,690 B2
(45) Date of Patent: Apr. 28, 2020

(54) FOOT EXFOLIATION DEVICE

(71) Applicant: Rasheena Stewart, Philadelphia, PA (US)

(72) Inventor: Rasheena Stewart, Philadelphia, PA (US)

( * ) Notice: Subject to any disclaimer, the term of this patent is extended or adjusted under 35 U.S.C. 154(b) by 0 days.

(21) Appl. No.: 16/147,664

(22) Filed: Sep. 29, 2018

(65) Prior Publication Data

US 2020/0100629 A1 Apr. 2, 2020

(51) Int. Cl.
*A47K 7/02* (2006.01)

(52) U.S. Cl.
CPC ..... *A47K 7/024* (2013.01); *A47K 7/026* (2013.01)

(58) Field of Classification Search
CPC ..... A47L 23/22; A47L 23/26; A47L 23/266; A47K 7/024; A47K 7/026; A46B 17/00; A46B 17/02; A46B 17/08
USPC ..... 4/605, 606; 15/110, 114, 210.1, 160, 15/161, 104.93, 104.94
See application file for complete search history.

(56) References Cited

U.S. PATENT DOCUMENTS 5,996,160 A * 12/1999 Pruitt ..... A47L 23/24 15/104.92
6,684,444 B2 * 2/2004 Wheeler ..... A47K 7/026 15/110
7,578,021 B1 * 8/2009 Figueroa ..... A47K 7/024 15/104.92
7,967,521 B2 * 6/2011 Schiavo ..... A47K 7/04 4/622
8,533,888 B2 * 9/2013 Kessler ..... A47L 23/263 15/104.92
8,631,523 B1 * 1/2014 Schneider ..... A47K 7/024 4/606
8,656,546 B2 * 2/2014 Wang ..... A47K 7/026 15/104.92
2003/0204927 A1 * 11/2003 Kelly ..... A47K 7/026 15/160
2007/0022527 A1 * 2/2007 Russo ..... A47K 7/026 4/606

* cited by examiner

*Primary Examiner* — Erin Deery

(57) ABSTRACT

An exfoliation device for feet for use in a bathtub or shower comprising washable and replaceable parts created specifically for attending to the feet while standing, without the need to bend over structured and arranged to provide a user with an effortless means of exfoliating the feet and removing dead skin, while standing in the shower or bath.

12 Claims, 4 Drawing Sheets

FOOT EXFOLIATION DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of foot spa devices and more specifically relates to an exfoliation device for feet for use in a bathtub or shower comprising washable and replaceable parts created specifically for attending to the feet while standing, without the need to bend over structured and arranged to provide a user with an effortless means of exfoliating the feet and removing dead skin, while standing in the shower or bath.

2. Description of the Related Art

Bathing can be one of the most enjoyable and invigorating activities of the day. Providing an eye-opening renewal, taking a shower upon waking is, for many, a preferred method of greeting the morning. Allowing the cool, pulsating spray of the water to cascade over the face and to gently massage the neck, shoulders and back can be a delightful energizer even for the groggiest of people. Conversely, others may favor a relaxing, luxurious bath at the end of hectic and busy days. Soaking in a bathtub full of warm, scented water and surrounded by fragrant caressing bubbles can provide much needed respite for the mind, body, and spirit.

While quick showers are revitalizing and long baths help soothe the senses and ease tension, both methods of bathing share the practical purpose of restoring good personal hygiene. Whether it is the desire to feel fresh and clean for work or school, to shower off sweat and grime after playing or working out, or to totally immerse the body during an end-of-the-day bath, feeling completely cleansed is essential. In addition to recognizing the importance of good personal hygiene, consumers also desire to keep their skin healthy.

As many can attest, however, a complete cleansing of some areas of the body can be quite challenging. For instance, positioning a washcloth or other bath sponge at the small of the back or between the shoulder blades is a difficult task for most, and can be almost impossible for those with limited mobility. Moreover, bending down or over to scrub bottoms of the feet can be fraught with risk for even the healthiest of consumers. Not only can this endeavor place strain on the back, but balancing on one foot while washing the other can cause one to lose his balance, a dangerous risk in a wet, slippery shower stall or bathtub. Due to these hindrances, the sensitive feet cannot always receive a total cleansing, and can become susceptible to drying and chafing. A solution is needed.

Various attempts have been made to solve problems found in foot spas art.

Among these are found in: U.S. Pub. No. 2007/0089758 to Portia Koutscumbos; U.S. Pat. No. 8,505,551 to Josephine Moretti; and U.S. Pat. No. 7,578,021 to Victor Figueroa. This prior art is representative of exfoliating devices for use during bathing and showering.

Ideally, an exfoliation device for feet for use in a bathtub or shower should be user-friendly and safe in-use and yet would operate reliably and be manufactured at a modest expense. Thus, a need exists for an exfoliation device for feet for use in a bathtub or shower comprising washable and replaceable parts created specifically for attending to the feet while standing, without the need to bend over structured and arranged to provide a user with an effortless means of exfoliating the feet and removing dead skin, while standing in the shower or bath and to avoid the above-mentioned problems.

BRIEF SUMMARY OF THE INVENTION

In view of the foregoing disadvantages inherent in the known foot spa device art, the present invention provides a novel exfoliation device for feet for use in a bathtub or shower (Entitled the Xquisite Foot Spa). The general purpose of the present invention, which will be described subsequently in greater detail is to provide an exfoliation device for feet for use in a bathtub or shower comprising washable and replaceable parts created specifically for attending to the feet while standing, without the need to bend over structured and arranged to provide a user with an effortless means of exfoliating the feet and removing dead skin, while standing in the shower or bath.

An exfoliation device for feet for use in a bathtub or shower, comprising: a main panel including a top side and a bottom side; a pumice stone; a brush member; and a cloth member. The top side includes: a right side portion; a left side portion; and a middle portion. Wherein the right side portion is adapted to hold a pumice stone thereon. Wherein the left side portion is adapted to hold a brush member thereon. Wherein the middle portion is located in between the right and left side portions and is adapted to hold a cloth member thereon.

The bottom side includes a plurality of suction cups attached thereto adapted to releasably attach the exfoliation device to a surface of a bathtub or shower.

Wherein the pumice stone is releasably attached to the right side portion of the top side of the main panel. Wherein the brush member is removably held by the left side portion of the top side of the main panel.

Wherein the cloth member is removably held by the left side portion of the top side of the main panel.

Wherein when the exfoliation device is releasably attached to the surface of the bathtub or shower a user can rub their feet upon the pumice stone to exfoliate skin therefrom while bathing, and then wipe their feet upon the cloth member to wipe away any excess skin left there behind. Wherein the brush member is used to clean off the pumice stone after use.

An improved bathing unit comprising: one of a bathtub and shower unit and an exfoliation device for feet for use in the one of a bathtub and shower. The one of a bathtub and shower unit includes a water spout; and a top surface. Wherein the top surface is adapted to support a person while bathing and is adapted to releasably attach with a plurality of suction cups.

The present invention holds significant improvements and serves as a exfoliation device for feet for use in a bathtub or shower. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an exfoliation device for feet for use in a bathtub or shower (Entitled the Xquisite Foot Spa), constructed and operative according to the teachings of the present invention.

The various embodiments of the present invention will hereinafter be described in conjunction with the appended drawings, wherein like designations denote like elements.

DETAILED DESCRIPTION

Figure 1:
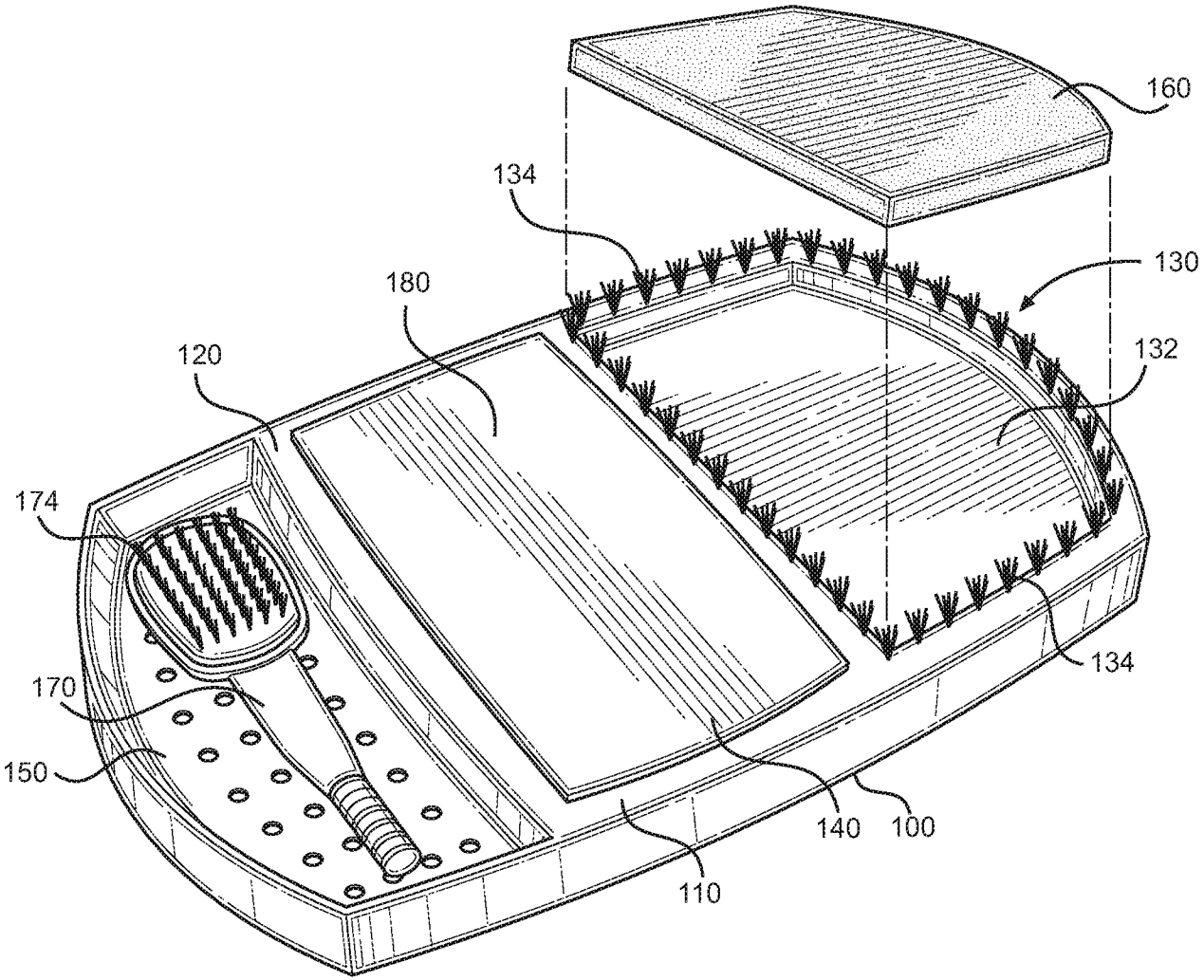
FIG. 1 shows a perspective view illustrating a top side of an exfoliation device for feet according to an embodiment of the present invention.

As discussed above, embodiments of the present invention relate to a foot spa device and more particularly to a exfoliation device for feet for use in a bathtub or shower (Entitled the Xquisite Foot Spa) comprising washable and replaceable parts created specifically for attending to the feet while standing, without the need to bend over structured and arranged to provide a user with an effortless means of exfoliating the feet and removing dead skin, while standing in the shower or bath.

Generally speaking, the Xquisite Foot Spa is a stationary device that facilitates exfoliation of the feet by simply standing. Based in a rectangular, water-resistant rubberized frame, this product would be rectangular in shape. Measuring approximately fourteen inches (14") in length, ten inches (10") in width, and one and one half inches (1½") in depth, the Xquisite Foot Spa would consist of three (3) separate sections. The right side would offer a recessed niche that houses an appropriately sized pumice stone, upon which a user would place the foot, and rubbing in several directions, expediently exfoliate. Placed center, a microfiber, cushioned cloth would serve to swipe away any excess skin left behind by the exfoliating procedure. Lastly, the left side of the Xquisite Foot Spa would house a handy, rubber-bristled brush that is used to clean off the pumice stone after use. To ensure installation inside a shower or bath, the bottom surface would feature a series of suction cups that steadfastly adhere to the shower or bath floor. As an additional consideration, the Xquisite Foot Spa could be offered in a wide variety of colors to appeal to personal tastes, or to match virtually any bathroom decor.

There are several benefits and advantages associated with this unique product invention. Foremost, the handy Xquisite Foot Spa device would allow consumers to simply and effectively take care of the feet while remaining in an upright position. With the Xquisite Foot Spa's combination of a pumice stone and cleansing, microfiber cloth, this practical product would ensure that unsightly dead skin is quickly and efficiently eradicated, without having to contort the body or engage in laborious scrubbing. Consumers suffering from limited mobility problems, such as sore and arthritic backs, will certainly appreciate that the handy Xquisite Foot Spa would eliminate painful, and sometimes impossible, attempts to reach the feet with a handheld instrument. Pregnant women will also love the ease inherent in the Xquisite Foot Spa, as it can be quite difficult for them to reach the feet while in the shower or bath. In addition to assisting them in the bath, this product would further provide these particular users with a sense of independence and confidence in being able to effectively clean themselves without assistance. As the Xquisite Foot Spa is safe to operate, it can be used and enjoyed by children as well as adults. Created ideally for the discerning female, this versatile product could be employed by anyone who wishes to ensure healthy, beautiful feet.

Figure 2:
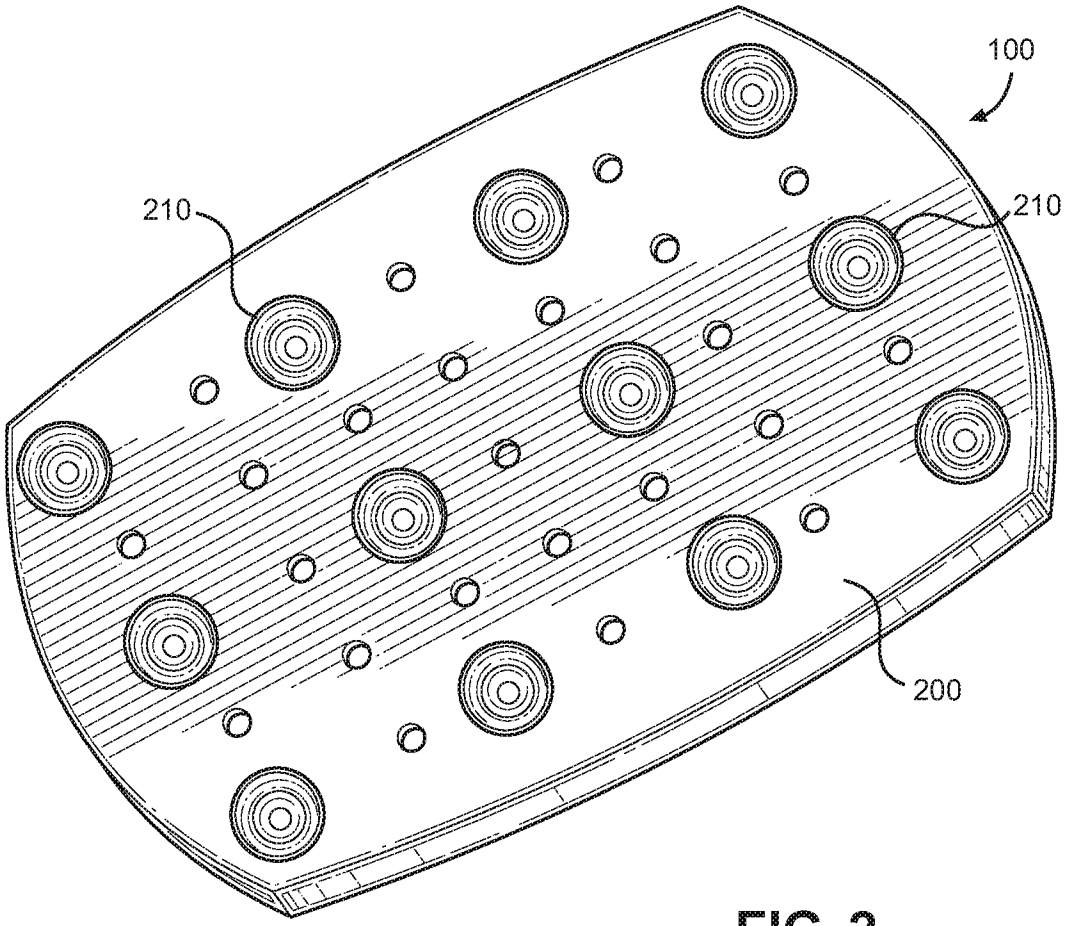
FIG. 2 is a perspective view illustrating a bottom side of an exfoliation device for feet according to an embodiment of the present invention of FIG. 1.

Referring to the drawings by numerals of reference there is shown in FIGS. 1 & 2, perspective views illustrating exfoliation device 100 for feet for use in bathtub 300 or shower 410 according to an embodiment of the present invention.

Figure 3:
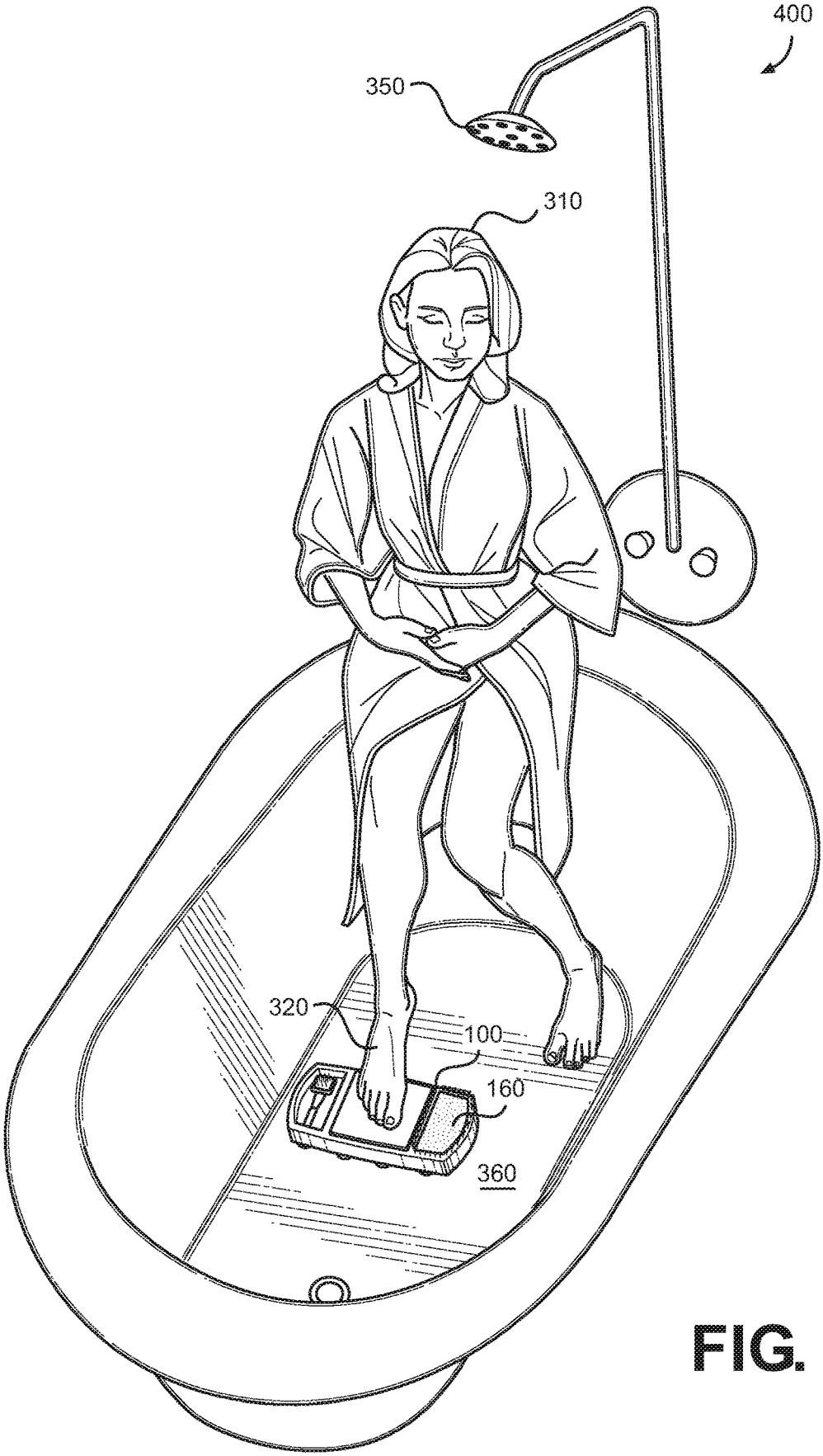
FIG. 3 is a perspective view illustrating improved bathing unit having an exfoliation device for feet being used in a bathtub according to an embodiment of the present invention of FIG. 1.
Figure 4:
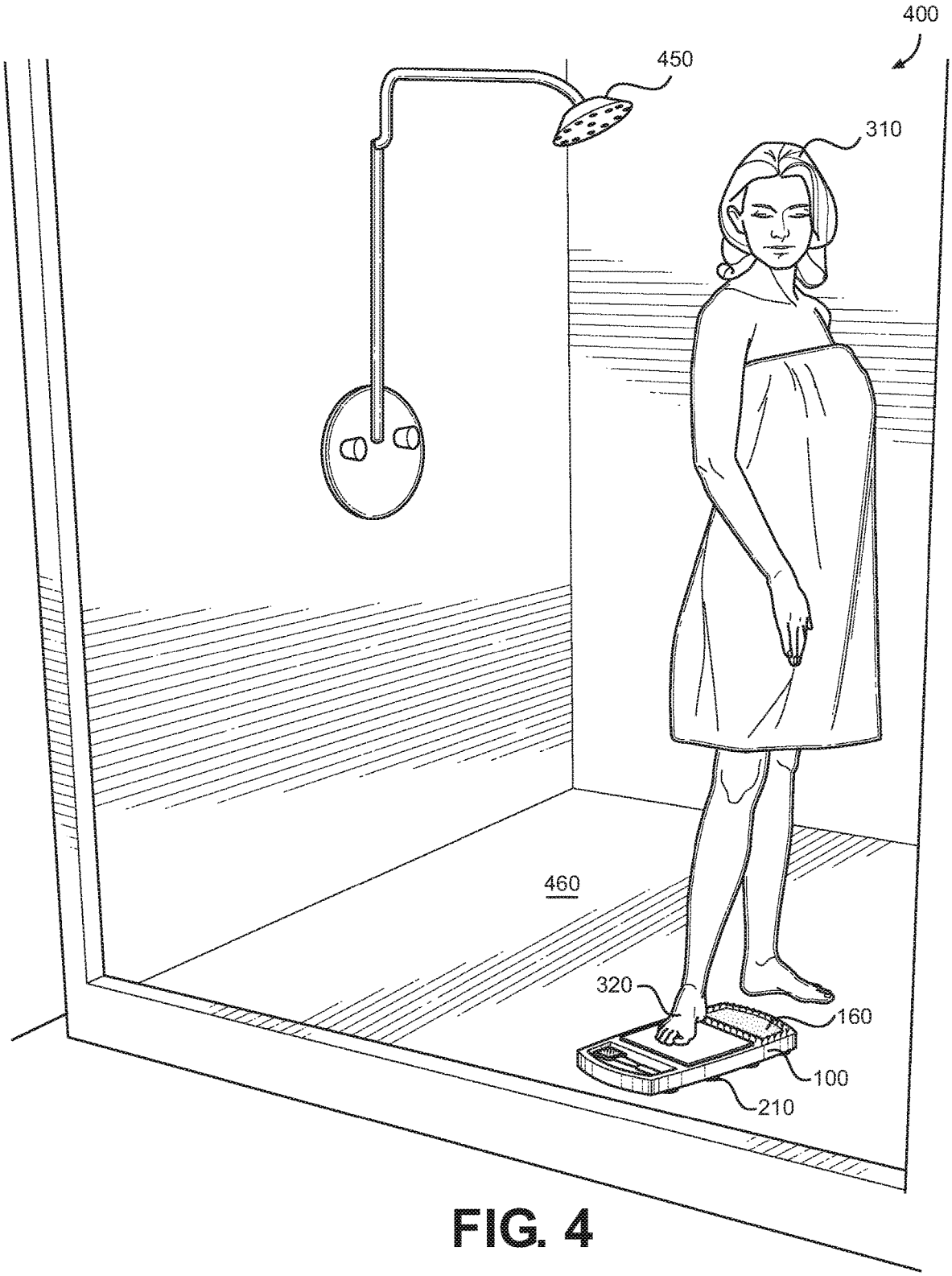
FIG. 4 is a perspective view illustrating improved bathing unit having an exfoliation device for feet being used in a shower unit according to an embodiment of the present invention of FIG. 1.

Exfoliation device 100 for feet for use in bathtub 300 or shower 410, comprising: main panel 110 including top side 120 and bottom side 200; pumice stone 160; brush member 170; and cloth member 180. Wherein main panel 110 is formed having a rectangular shape. Wherein the rectangular shape of main panel 110 is formed having dimensions including fourteen inches in length, ten inches in width, and one and one half inches in depth. Top side 120 includes: right side portion 130; left side portion 150; and middle portion 140.

Wherein right side portion 130 is adapted to hold pumice stone 160 thereon. Wherein right side portion 130 includes recessed niche 132 therein adapted to releasably hold pumice stone 160 therein. Wherein right side portion 130 further includes series of bristle members 134 surrounding recessed niche 132 and are adapted to help remove excess dead skin from a feet 320 of user 310 while rubbing them upon pumice stone 160 as shown in FIGS. 3 and 4. Wherein pumice stone 100 is releasably attached to right side portion 130 of top side 120 of main panel 110.

Wherein left side portion 150 is adapted to hold brush member 170 thereon. Wherein brush member 170 includes bristles 174 made from rubber. Wherein brush member 170 is removably held by left side portion 150 of top side 120 of main panel 110.

Wherein middle portion 140 is located in between right side portion 130 and left side portion 110 and is adapted to hold cloth member 180 thereon. Wherein cloth member 180 is removably held by left side portion 150 of top side 120 of main panel 110. Wherein cloth member 180 is formed from a micro-fiber material.

Bottom side 200 includes plurality of suction cups 210 attached thereto adapted to releasably attach exfoliation device 100 to a surface of bathtub 300 or shower 410 as shown in FIG. 2.

Wherein when exfoliation device 100 is releasably attached to a surface of bathtub 300 or shower 410 user 310 can rub feet 320 upon pumice stone 160 to exfoliate skin therefrom while bathing, and then wipe feet 320 upon cloth member 180 to wipe away any excess skin left there behind. Wherein brush member 170 is used to clean off pumice stone 160 after use.

Referring to the drawings by numerals of reference there is shown in FIGS. 3 & 4, perspective views illustrating improved bathing unit 400 according to an embodiment of the present invention.

Improved bathing unit 400 comprising: one of bathtub 300 and shower unit 410 and an exfoliation device 100 for feet 320 for use in one of bathtub 300 and shower 400. The one of bathtub 300 and shower unit 400 includes water spout 350 on bathtub 300 and water spout 450 of shower 410; and top surface 360 on bathtub 300 and top surface 460 of shower 400. Wherein top surface 120 is adapted to support user 310 while bathing and is adapted to releasably attach with plurality of suction cups 210.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An exfoliation device for feet for use in a bathtub of shower, comprising:

a main panel including a top side, the top side including:

a right side portion having a perimeter formed by brush bristles extending away from the top side, each side of the perimeter formed by only a single row of brush bristles, the right side portion having a pumice stone releasably attached thereto;

a left side portion having a removable brush member held thereon; and a middle portion located in between said right and left side portions, the middle portion having a cloth member removably held by said middle portion;

a bottom side including a plurality of suction cups attached thereto adapted to releasably attach said exfoliation device to a surface of a bathtub or shower;

wherein when said exfoliation device is releasably attached to said surface of said bathtub or shower a user is enabled to rub their feet upon said pumice stone to exfoliate skin therefrom while bathing, to brush excess skin from their feet using the brush bristles forming the perimeter, and then to wipe their feet upon said cloth member to wipe away any excess skin left there behind; and wherein said removable brush member is used to clean off pumice stone after use.

2. The exfoliation device of claim 1, wherein said right side portion includes a recessed niche within the perimeter that receives and releasably holds said pumice stone.

3. The exfoliation device of claim 1, wherein said cloth member is formed from a micro-fiber material.

4. The exfoliation device of claim 1, wherein said removable brush member includes bristles made from rubber.

5. The exfoliation device of claim 1, wherein said main panel is formed having a rectangular shape.

6. The exfoliation device of claim 5, wherein said rectangular shape of said main panel is formed having dimensions including fourteen inches in length, ten inches in width, and one and one half inches in depth.

7. An improved bathing unit comprising:

one of a bathtub and a shower unit including:

a water spout; and a top surface;

wherein said top surface is adapted to support a person while bathing; and an exfoliation device for feet for use in said one of a bathtub and shower comprising:

a main panel including a top side, the top side including:

a right side portion having a perimeter formed by brush bristles extending away from the top side, each side of the perimeter formed by only a single row of brush bristles, the right side portion having a pumice stone releasably attached thereto;

a left side portion having a removable brush member held thereon; and a middle portion located in between said right and left side portions, the middle portion having a cloth member removably held by said middle portion;

a bottom side including a plurality of suction cups attached thereto adapted to releasably attach said exfoliation device to said top surface;

wherein when said exfoliation device is releasably attached to said surface of said bathtub or shower a user is enable to rub their feet upon said pumice stone to exfoliate skin therefrom while bathing, to brush excess skin from their feet using the brush bristles forming the perimeter, and then to wipe their feet upon said cloth member to wipe away any excess skin left there behind; and wherein said removable brush member is used to clean off pumice stone after use.

8. The improved bathing unit of claim 7, wherein said right side portion includes a recessed niche within the perimeter that receives and releasably holds said pumice stone.

9. The improved bathing unit of claim 7, wherein said cloth member is formed from a microfiber material.

10. The improved bathing unit of claim 7, wherein said removable brush member includes bristles made from rubber.

11. The improved bathing unit of claim 7, wherein said main panel is formed having a rectangular shape.

12. The improved bathing unit of claim 11, wherein said rectangular shape of said main panel is formed having dimensions including fourteen inches in length, ten inches in width, and one and one half inches in deep.

* * * * *